US006831418B1

(12) United States Patent
Wu

(10) Patent No.: US 6,831,418 B1
(45) Date of Patent: Dec. 14, 2004

(54) RAPID ASSEMBLED AND DETACHED STRUCTURE OF LAMP

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/461,962

(22) Filed: Jun. 16, 2003

(51) Int. Cl.[7] ..... H01K 7/00

(52) U.S. Cl. ..... 315/76; 315/33; 260/226; 439/676

(58) Field of Search ..... 315/76, 33, 56, 315/58; 362/226, 457, 414, 412; 439/676, 242, 234–236, 243

(56) References Cited

U.S. PATENT DOCUMENTS 5,353,209 A * 10/1994 Foottit ..... 362/226
6,390,646 B1 * 5/2002 Yan ..... 362/414
6,459,204 B1 * 10/2002 Yan ..... 315/58
6,565,240 B1 * 5/2003 Wu ..... 362/405
6,626,707 B2 * 9/2003 Henrici et al. ..... 439/699.2
6,655,816 B2 * 12/2003 Wu ..... 362/226
6,715,899 B1 * 4/2004 Wu ..... 362/226

* cited by examiner

*Primary Examiner*—James Vannucci
*Assistant Examiner*—Ephrem Alemu

(57) ABSTRACT

A rapid assembled and detached structure of a lamp comprises a retaining seat, a lamp seat and a connector. The receiving hole is formed in the retaining seat. A bottom end of the receiving hole is mounted with a conductive receptacle. An outer side of the retaining seat is installed with an embedding hole. A lamp seat at a lower end of the retaining seat. A center of the lamp seat has a locating hole. After the retaining seat is installed in the locating hole of the lamp seat. The embedding hole of the retaining seat is communicable to the through hole of the lamp seat. A connector is received in the retaining seat. A bottom end of the connector has a conductive plug capable of being inserted into the receptacle. A receiving groove is formed on the connector and a reed is locked to the receiving groove.

5 Claims, 4 Drawing Sheets

RAPID ASSEMBLED AND DETACHED STRUCTURE OF LAMP

BACKGROUND OF THE INVENTION

The present invention relates to lamp assembly devices, and particularly to a rapid assembled and detached structure of a lamp. By the design of the present invention, a user can assemble the lamp rod by inserting it into the lamp seat easily; thus, the lamp is detachable for storage and transfer with a smaller volume.

The prior art buckling structures of lamps, such as wall lamps, seat lamps, or stand lamps, are assembled by screwing studs with nuts. Not only collision events easy occur, but also the locking tools (for example, spanners, openers, etc.) are necessary in assembly. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention is to provide a rapid assembled and detached structure of a lamp which comprises a retaining seat, a lamp seat and a connector. The receiving hole is formed in the retaining seat. A bottom end of the receiving hole is mounted with a conductive receptacle. An outer side of the retaining seat is installed with an embedding hole. A lamp seat at a lower end of the retaining seat. A center of the lamp seat has a locating hole. After the retaining seat is installed in the locating hole of the lamp seat. The embedding hole of the retaining seat is communicable to the through hole of the lamp seat. A connector is received in the retaining seat. A bottom end of the connector has a conductive plug capable of being inserted into the receptacle. A receiving groove is formed on the connector and a reed is locked to the receiving groove.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
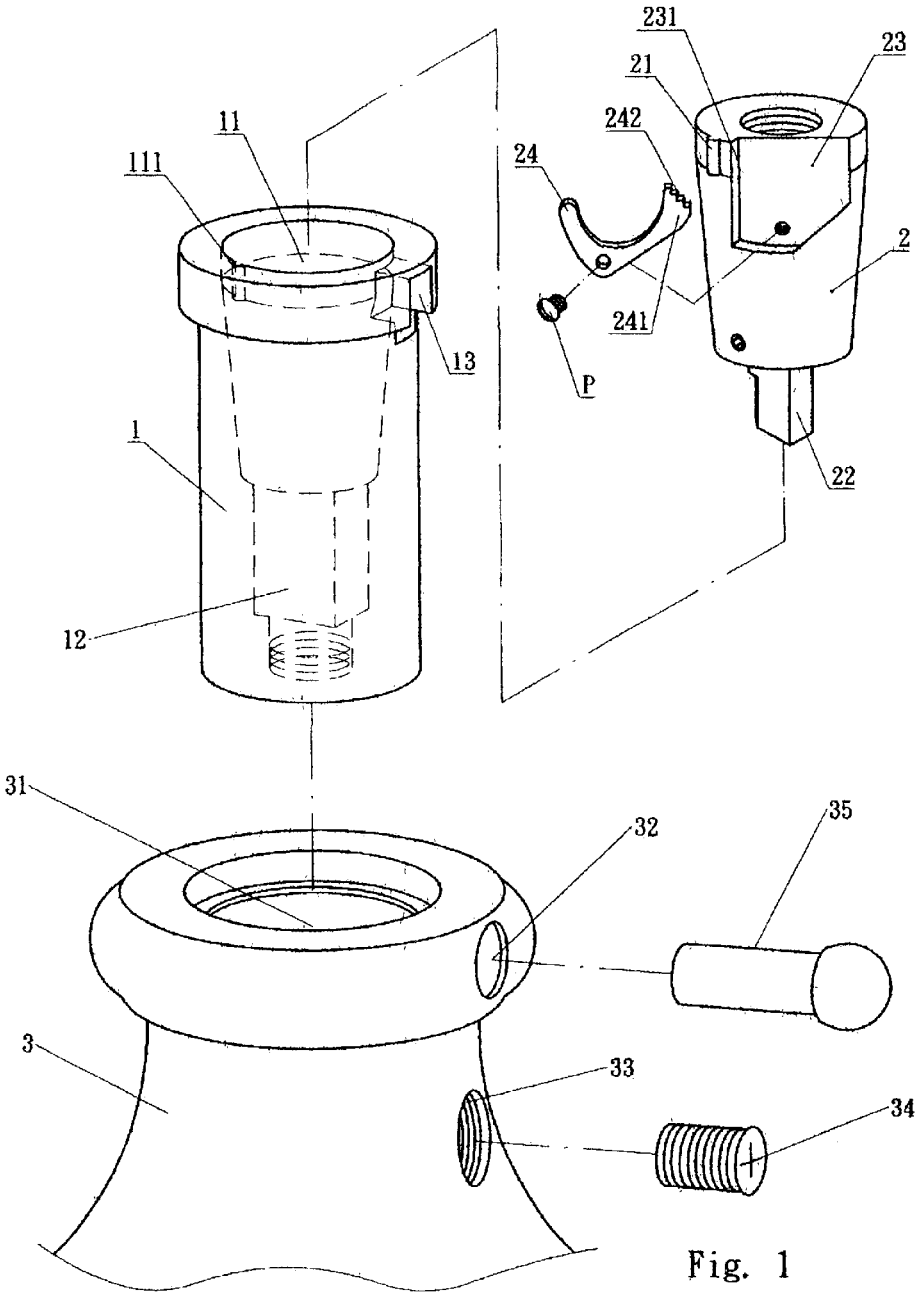
FIG. 1 is an exploded perspective view of the present invention.
Figure 2:
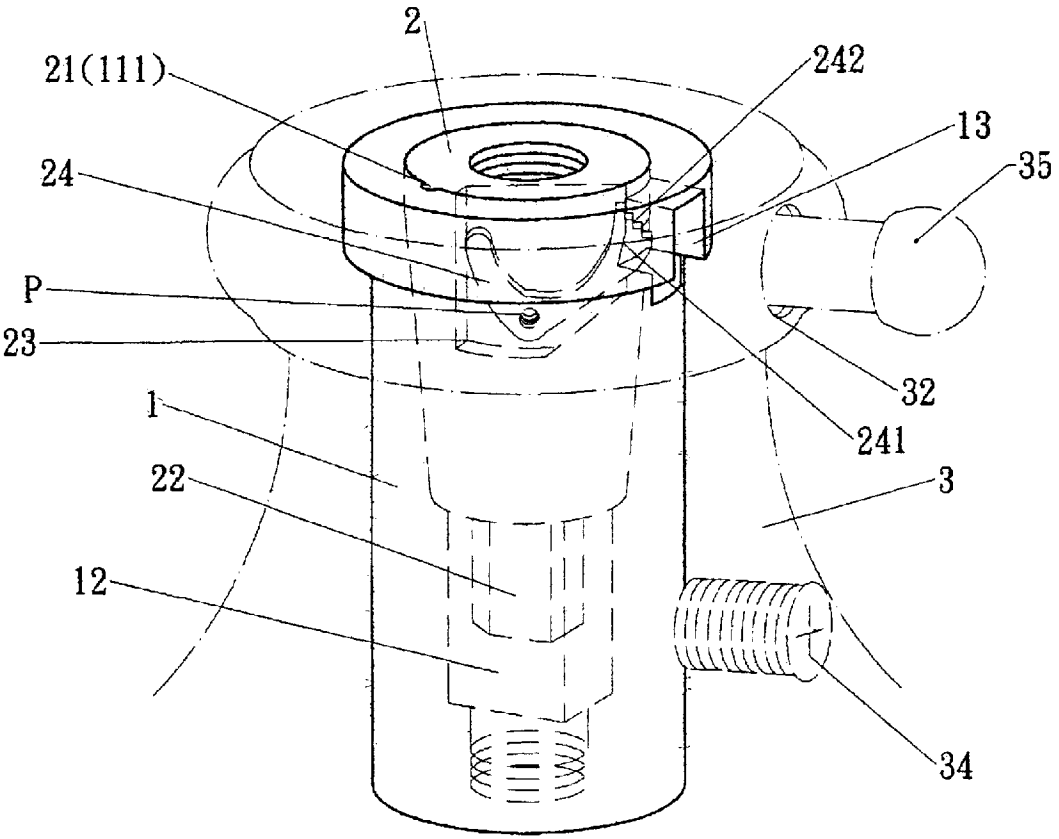
FIG. 2 is an assembled perspective view of the present invention.

With reference to FIGS. 1 and 2, the present invention includes a lamp seat 3, a retaining seat 1 at a top end of the lamp seat 3, and a connector 2 in the retaining seat 1.

A tapered receiving hole 11 is formed in the retaining seat 1. A bottom end of the receiving hole 11 is mounted with a conductive receptacle 12. A top end of the receiving hole 11 is formed with a recess 111. An outer side of the retaining seat 1 is formed with an embedding hole 13 which is communicable to the receiving hole 11 for positioning the connector 2.

A center of the lamp seat 3 has a locating hole 31. After the retaining seat 1 is installed in the locating hole 31 of the lamp seat 3, the embedding hole 13 of the retaining seat 1 is communicable to the through hole 32 of the lamp seat 3. A screw 34 is screwed into the screw hole 33 of the lamp seat 3 and then resists against the lamp seat 3 so that the retaining seat 1 is positioned in the locating hole 31 of the lamp seat 3.

The connector 2 has a tapered shape corresponding to the receiving hole 11 of the retaining seat 1. The upper outer edge of the connector 2 has a buckle 25 at a position corresponding to the recess 111 of the retaining seat 1. After the conductive receptacle 12 of the connector 2 is inserted into the receiving hole 11, the buckle 25 is embedded into the recess 111. A bottom end of the connector 2 has a conductive plug 22 capable of being inserted into the receptacle 12. A receiving groove 23 is formed on the connector 2. A reed 24 is locked to the receiving groove 23 by a screw P. One side of the reed 24 is a buckling portion 241 which slightly protrudes from an outer edge of the receiving groove 23 and another side of the reed 24 resists against an inner edge 231 of the receiving groove 23. A lateral edge of the buckling portion 241 is installed with a stop tooth bank 242. Thereby, when the connector 2 is inserted into the retaining seat 1, the buckling portion 241 is inserted into the embedding hole 13 of the retaining seat 1 and the stop tooth bank 242 resists against the edge of the embedding hole 13 to prevent the connector 2 from moving out of the retaining seat 1.

Figure 3:
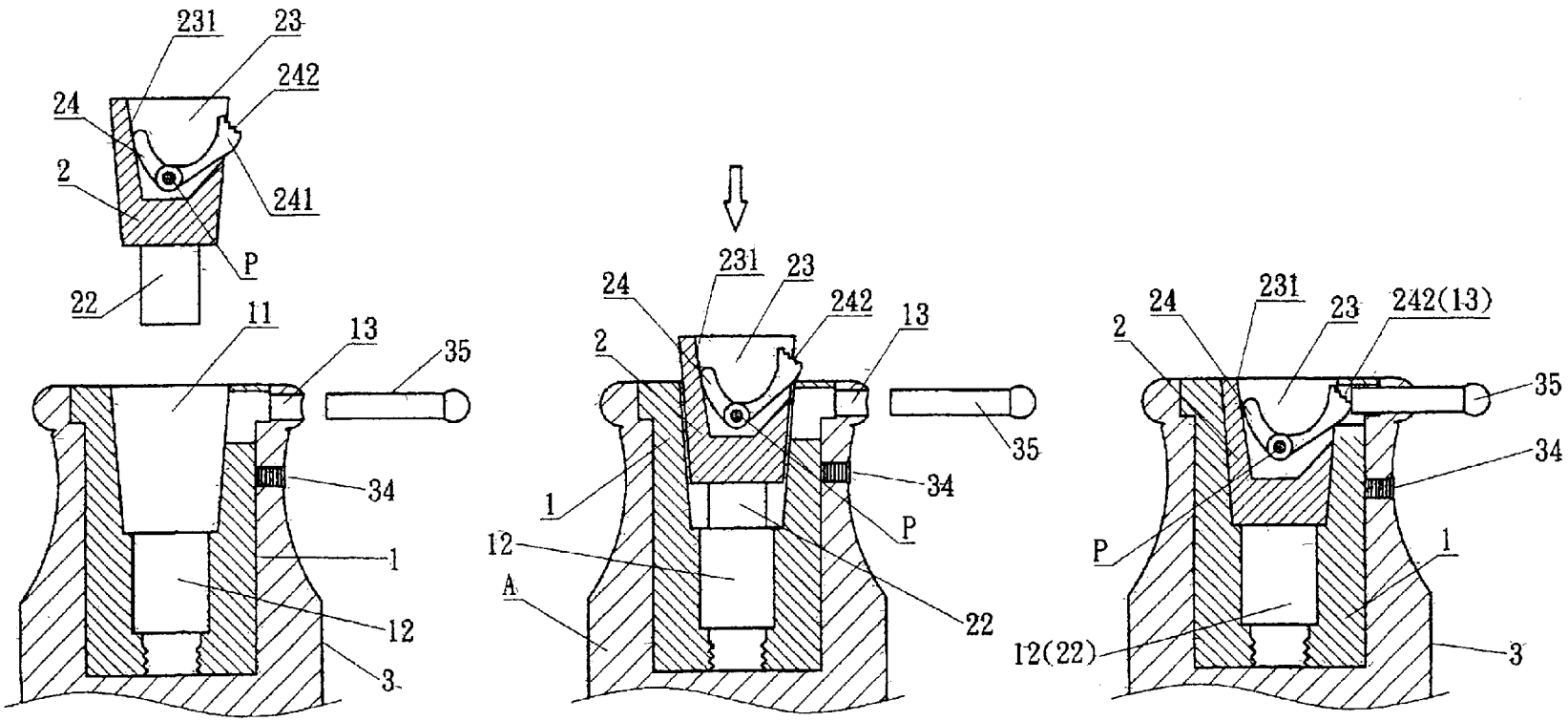
FIG. 3A shows one embodiment before the insertion of the lamp rod.
FIG. 3B shows the embodiment of FIG. 3A where the lamp rod is being inserted.
FIG. 3C shows the embodiment of FIG. 3A after the insertion of the lamp rod.

The operation of the present invention will be described herein with reference to FIG. 3. At first, the connector 2 is inserted into the receiving hole 11, and then the buckling portion 241 of the reed 24 in the receiving groove 23 of the connector 2 is pressed by the receiving hole 11 of the retaining seat 1 so as to be extruded inwards properly and be pushed inwards with the width of the receiving hole 11 (referring to FIG. 3B). When the buckling portion 241 of the reed 24 is aligned to the embedding hole 13 of the retaining seat 1, the buckling portion 241 will separate from the receiving hole 11 of the retaining seat 1 to be ejected out and passes through the stop tooth bank at the side of the buckling portion 241 to resist against the edge of the embedding hole 13 of the retaining seat 1 so as to prevent the connector 2 from leaving the retaining seat 1 (referring to FIG. 3C). Then, the conductive plug 22 of the connector 2 inserts into the conductive receptacle 12 of the retaining seat 1, and thus the connector 2 is positioned to the retaining seat 1. Therefore, power is conductive.

When it is desired to move the connector 2 out of the receiving hole 11 of the retaining seat 1 so as to separate the lamp, a push rod 35 is inserted into the through hole 32 of the lamp seat 3, at the same time, the reed in the embedding hole 13 of the retaining seat 1 will cause the buckling portion

241 to reduce inwards so as to separate from the embedding hole 13. By releasing the buckling effect, the connector 2 will leave from the receiving hole 11 of the retaining seat 1.

Figure 4:
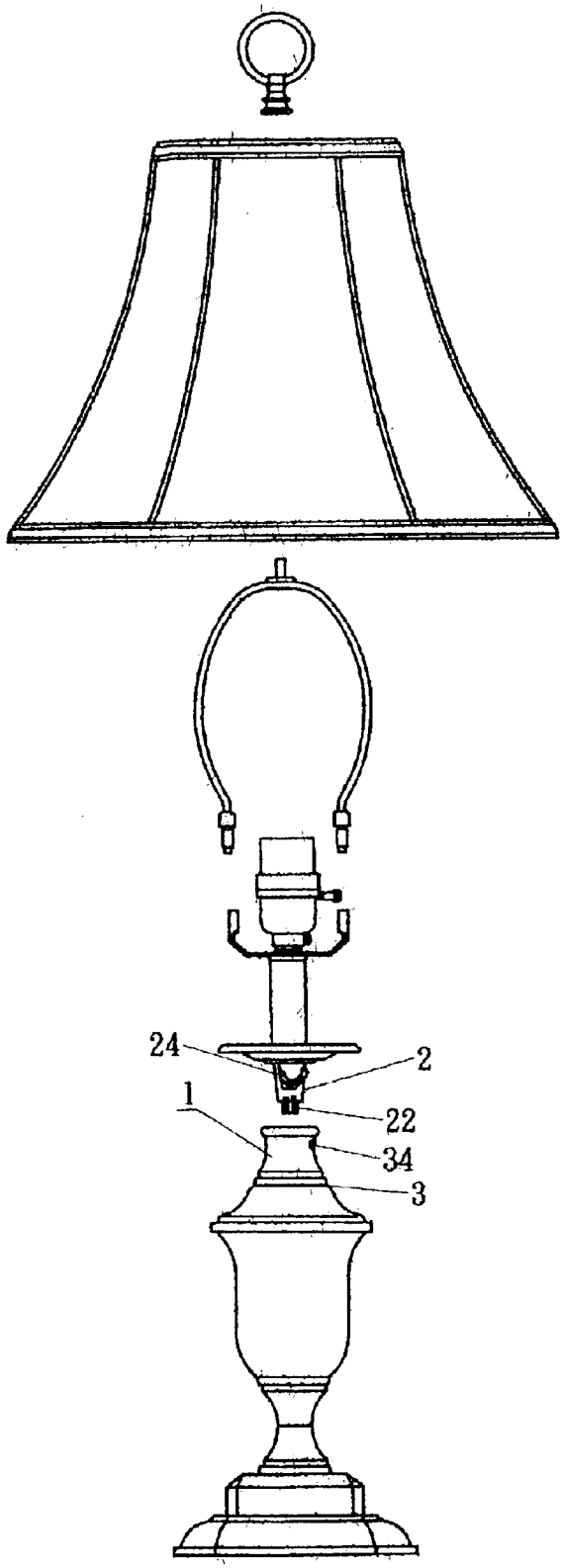
FIG. 4 shows an application of the present invention.

By the structure of the present invention, the connector 2 can be detached from the retaining seat 1 in advance so as to reduce the volume for transmission and storage. In use, it is only necessary to insert the connector 2 into the retaining seat 1 without using any tool. The user can assemble the present invention by himself (or herself). Thereby, the present invention can be used conveniently, as shown in FIG. 4.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A rapid assembled and detached structure of a lamp comprising:

a retaining seat; a receiving hole being formed in the retaining seat; a bottom end of the receiving hole being mounted with a conductive receptacle; an outer side of the retaining seat being formed with an embedding hole which is communicable to the receiving hole;

a lamp seat at a lower end of the retaining seat; a center of the lamp seat having a locating hole; after the retaining seat being installed in the locating hole of the lamp seat; the embedding hole of the retaining seat being communicable to the through hole of the lamp seat; the retaining seat being positioned in the locating hole of the lamp seat; and a connector received in the retaining seat; a bottom end of the connector having a conductive plug capable of being inserted into the receptacle; a receiving groove being formed on the connector; a reed being locked to the receiving groove; one side of the reed being a buckling portion which slightly protrudes from an outer edge of the receiving groove and another side of the reed resisting against an inner edge of the receiving groove; when the connector being inserted into the retaining seat, the buckling portion being inserted into the embedding hole of the retaining seat.

2. The rapid assembled and detached structure of a lamp as claimed in claim 1, wherein a top end of the receiving hole is formed with a recess; an upper outer edge of the connector has a buckle at a position corresponding to the recess; after the conductive receptacle of the connector is inserted into the receiving hole, the buckle is embedded into the recess.

3. The rapid assembled and detached structure of a lamp as claimed in claim 1, further comprising a post which is inserted into the through hole of the retaining seat to resist against the buckling portion of the reed.

4. The rapid assembled and detached structure of a lamp as claimed in claim 1, wherein a screw is screwed into the screw hole of the lamp seat and then resists against the lamp seat so that the retaining seat is positioned in the locating hole of the lamp seat.

5. The rapid assembled and detached structure of a lamp as claimed in claim 1, wherein a lateral side of the buckling portion is a stop tooth bank.

* * * * *